US005193279A

United States Patent [19]

Pierce

[11] Patent Number: 5,193,279

[45] Date of Patent: Mar. 16, 1993

[54] SHEETROCK CUTTING TOOL APPARATUS

[76] Inventor: Melvin Pierce, Rte. 4 Ridlerville Rd., Box 734, Sandersville, Ga. 31082.

[21] Appl. No.: 867,501

[22] Filed: Apr. 13, 1992

[51] Int. Cl.[5] ..... B26B 3/00; B26B 3/03

[52] U.S. Cl. ..... 30/305; 30/315

[58] Field of Search ..... 30/289, 294, 299, 301, 30/297, 296.1, 304, 305, 315; 411/439; 83/651

[56] References Cited

U.S. PATENT DOCUMENTS

| | | | |
|---|---|---|---|
| 1,028,761 | 6/1912 | McKnight | 411/439 |
| 1,417,985 | 5/1922 | Geiger | 30/305 |
| 1,977,902 | 10/1934 | Vermillion | 30/305 |
| 2,113,085 | 4/1938 | Higgs | 30/305 |
| 2,586,823 | 2/1952 | Huhn | 30/305 |
| 3,471,174 | 10/1969 | Manning | 411/440 |
| 3,630,249 | 12/1971 | Brumwin | 30/305 |
| 3,955,462 | 5/1976 | Thorsman | 411/439 |

*Primary Examiner*—Douglas D. Watts
*Assistant Examiner*—Paul M. Heyrana, Sr.
*Attorney, Agent, or Firm*—Leon Gilden

[57] ABSTRACT

A housing mounts a continuous side wall formed with a cutting edge arranged in a single plane, with the housing including a top wall, with a projecting flange extending upwardly of the top wall in an orthogonal relationship, and an upper distal end of the flange including an impact plate fixedly mounted thereto. In this manner, impact of the plate effects projection of the cutting edge into a sheetrock member to define a rectilinear cut for mounting of an electrical socket tool therewithin.

1 Claim, 5 Drawing Sheets

SHEETROCK CUTTING TOOL APPARATUS

BACKGROUND OF THE INVENTION

1. Field of the Invention

The field of invention relates to cutting apparatus, and more particularly pertains to a new and improved sheetrock cutting tool apparatus wherein the same is arranged to effect cutting of sheetrock for positioning electrical outlets therewithin.

2. Description of the Prior Art

Electrical outlets are of a conventional and standardized configuration, wherein positioning of such outlets within sheetrock typically has involved the use of a cutting blade or saw directed into the sheetrock to effect its cutting for positioning of the outlet in proper orientation relative to the sheetrock opening thusly cut. The instant invention attempts to overcome deficiencies of the prior art by providing for a unitary tool member arranged for the ease of the cutting sheetrock for positioning electrical outlets therethrough. Prior art cutting devices utilizing lower cutting edges are set forth in the U.S. Pat. Nos. 2,568,284 to Harrison and 4,009,625 to Pfaff.

As such, it may be appreciated that there continues to be a need for a new and improved sheetrock cutting tool apparatus as set forth by the instant invention which addresses both the problems of ease of use as well as effectiveness in construction in arranging the mounting and positioning of a cutting edge relative to sheetrock for its cutting and in this respect, the present invention substantially fulfills this need.

SUMMARY OF THE INVENTION

In view of the foregoing disadvantages inherent in the known types of cutting tool structures now present in the prior art, the present invention provides a sheetrock cutting tool apparatus wherein the same is directed to the cutting of sheetrock for positioning of electrical outlets therethrough. As such, the general purpose of the present invention, which will be described subsequently in greater detail, is to provide a new and improved sheetrock cutting tool apparatus which has all the advantages of the prior art cutting tool apparatus and none of the disadvantages.

To attain this, the present invention provides a housing mounting a continuous side wall formed with a cutting edge arranged in a single plane, with the housing including a top wall, with a projecting flange extending upwardly of the top wall in an orthogonal relationship, and an upper distal end of the flange including an impact plate fixedly mounted thereto. In this manner, impact of the plate effects projection of the cutting edge into a sheetrock member to define a rectilinear cut for mounting of an electrical socket tool therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sheetrock cutting tool apparatus which has all the advantages of the prior art cutting tool apparatus and none of the disadvantages.

It is another object of the present invention to provide a new and improved sheetrock cutting tool apparatus which may be easily and efficiently manufactured and marketed.

It is a further object of the present invention to provide a new and improved sheetrock cutting tool apparatus which is of a durable and reliable construction.

An even further object of the present invention is to provide a new and improved sheetrock cutting tool apparatus which is susceptible of a low cost of manufacture with regard to both materials and labor, and which accordingly is then susceptible of low prices of sale to the consuming public, thereby making such sheetrock cutting tool apparatus economically available to the buying public.

Still yet another object of the present invention is to provide a new and improved sheetrock cutting tool apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
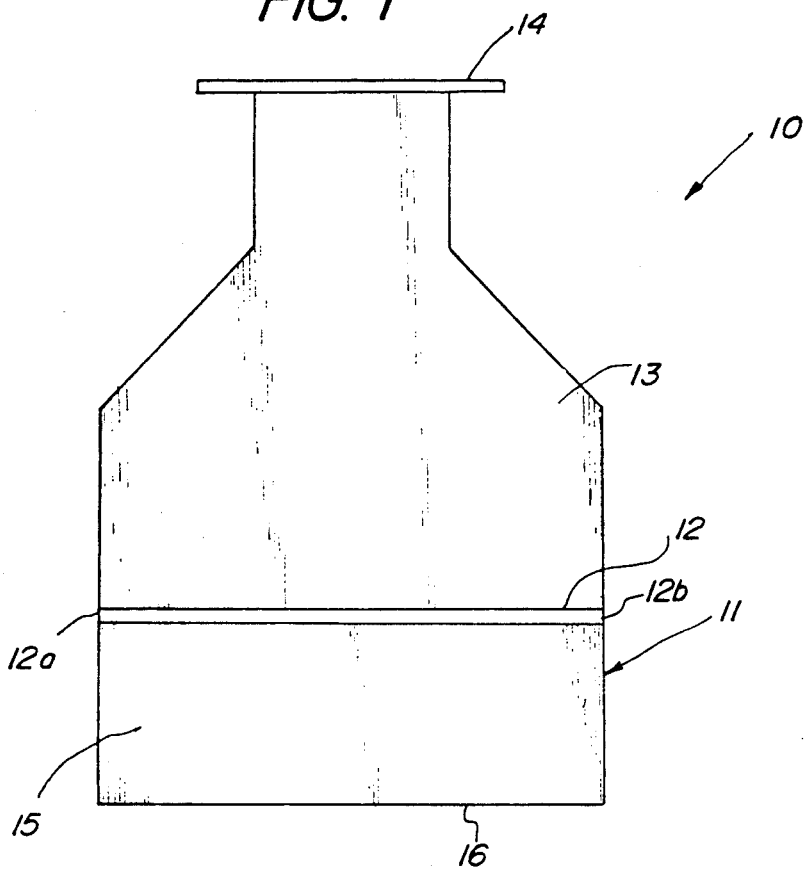
FIG. 1 is an orthographic side view of the instant invention.
Figure 2:
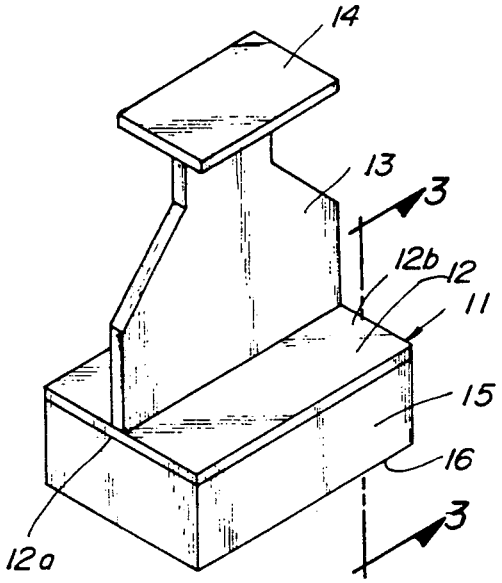
FIG. 2 is an isometric illustration of the instant invention.
Figure 3:
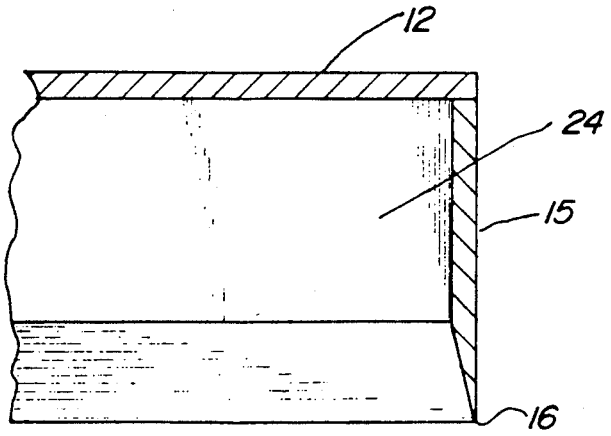
FIG. 3 is an orthographic view, taken along the lines 3—3 of FIG. 2 in the direction indicated by the arrows.

With reference now to the drawings, and in particular to FIGS. 1 to 11 thereof, a new and improved sheetrock cutting tool apparatus embodying the principles and concepts of the present invention and generally designated by the reference numeral 10 will be described.

More specifically, the sheetrock cutting tool apparatus 10 of the instant invention essentially comprises a cutting tool housing 11, including a housing top wall 12. The top wall 12 includes a top wall forward edge 12*a* spaced from and parallel a top wall rear edge 12*b*. A projecting flange 13 is orthogonally mounted medially of the top wall 12 extending orthogonally relative to the forward edge 12*a* and rear edge 12*b* medially bisecting the top wall forward and rear edges. An impact plate 14 is orthogonally mounted to an upper distal end of the projecting flange 13 for receiving impact thereon, with the housing including a housing continuous side wall 15 and the housing side wall 15 including a side wall lower continuous cutting edge 16 of a rectilinear configuration arranged in a single plane. The side wall 15 is further defined by housing first and second side walls 23 and 24 (e.g. see FIG. 5) arranged in a spaced parallel relationship.

Figure 4:
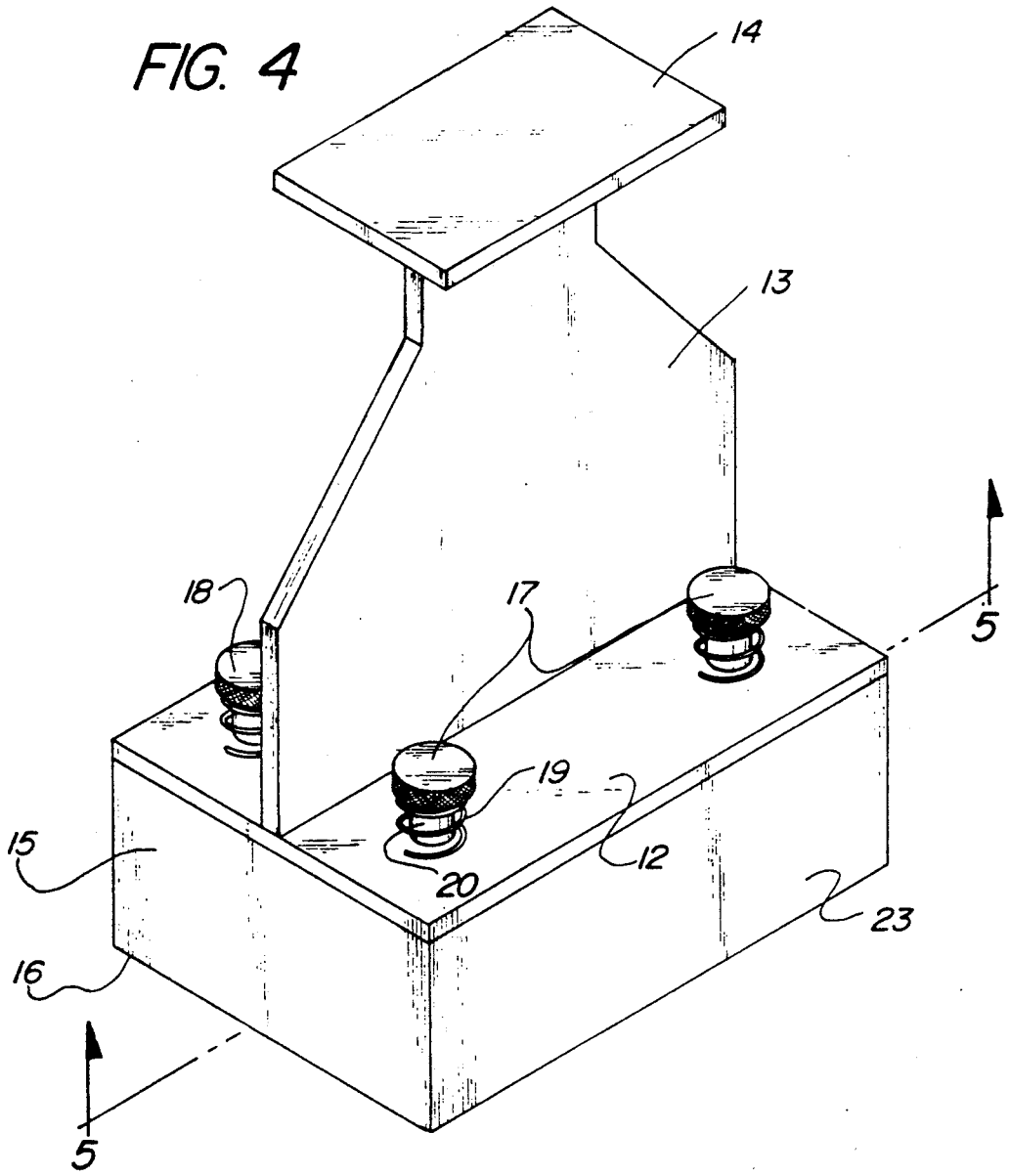
FIG. 4 is an isometric illustration of a modified top wall of the invention.
Figure 5:
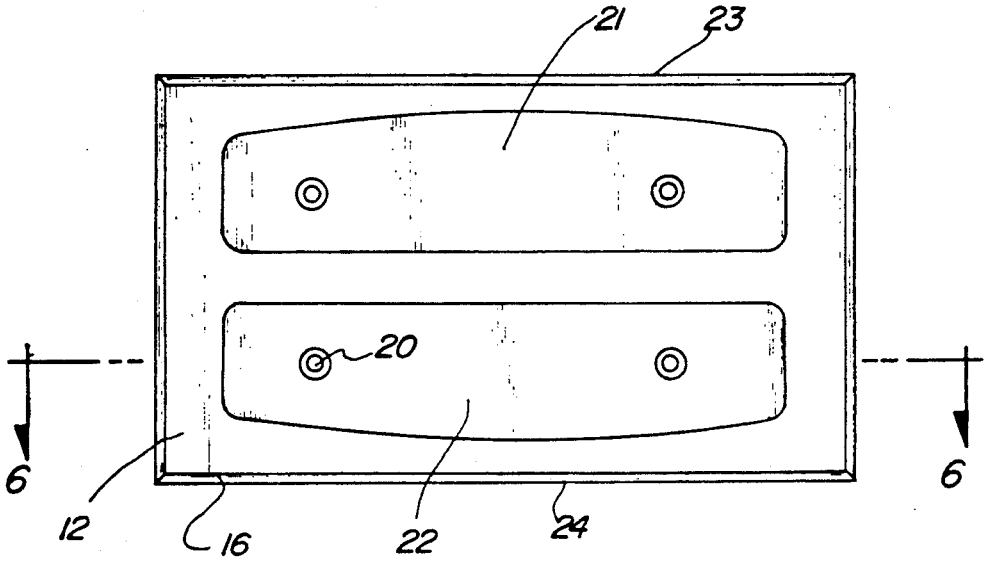
FIG. 5 is an orthographic view, taken along the lines 5—5 of FIG. 4 in the direction indicated by the arrows.
Figure 6:
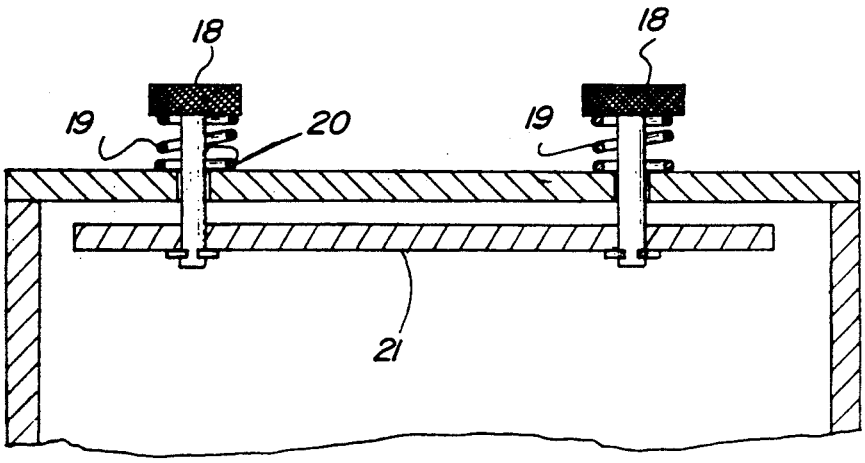
FIG. 6 is an orthographic view, taken along the lines 6—6 of FIG. 5 in the direction indicated by the arrows.

The FIG. 4 illustrates the use of first and second projecting heads 17 and 18 extending above the top wall 12, with the first projecting head 17 positioned on a first side of the projecting flange 13, with the second projecting heads 18 positioned on a second side of the projecting flange 13 adjacent the second side wall 24. Each projecting head is fixedly mounted to an upper distal end of a projecting rod 20 reciprocatably mounted in an orthogonal relationship through the top wall 12, with the projecting rods 20 of the first projecting heads 17 fixedly mounted to a first ejector plate 21 below the top wall 12 within the housing. A second ejector plate 22 is mounted to the projecting heads 20 below the second projecting heads 18 within the housing and below the top wall 12. In this manner, components of sheetrock received within the housing are readily ejected therefrom subsequent to a cutting procedure. Further, to maintain the ejector plates in a raised orientation, each projecting head includes a spring member 19 captured between the associated projecting head and the top wall 12, in a manner as illustrated in the FIG. 6 for example.

Figure 7:
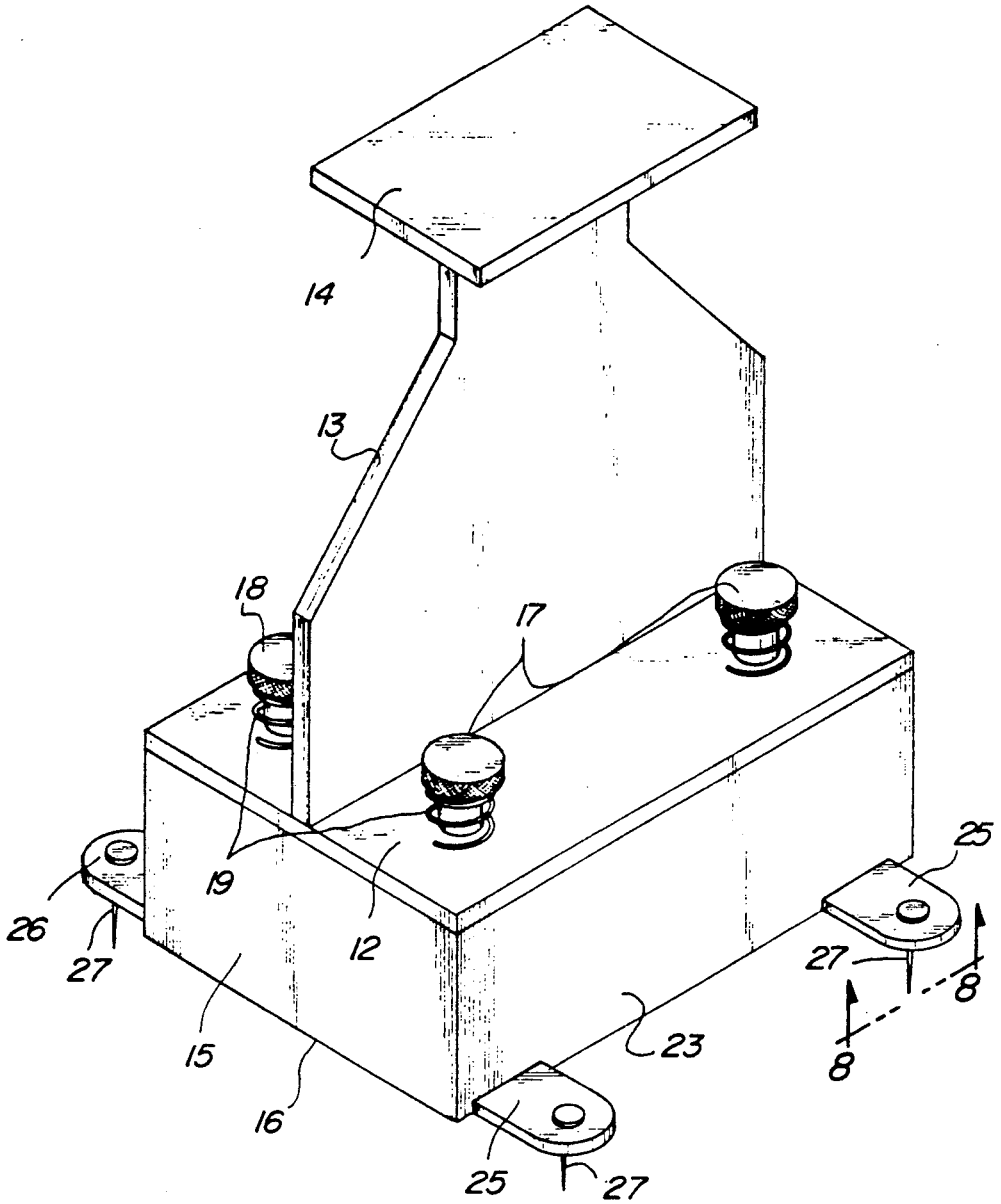
FIG. 7 is an isometric illustration of the cutting tool utilizing mounting flanges thereon for temporary positioning of the structure relative to a sheetrock panel.
Figure 8:
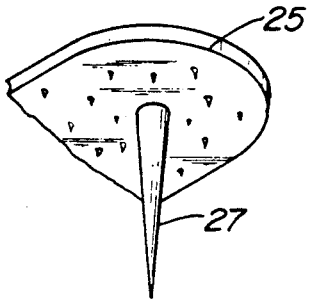
FIG. 8 is an orthographic view, taken along the lines 8—8 of FIG. 7 in the direction indicated by the arrows, illustrated in isometric.

The apparatus as further indicated in the FIG. 7 is arranged to include a plurality of first mounting flanges 25 orthogonally and integrally mounted to the first side wall 23 adjacent the cutting edge 16, with a plurality of second mounting flanges 26 orthogonally mounted to the second side wall 24 adjacent the cutting edge 16. Each mounting flange of the mounting flanges 25 and 26 includes a single spike 27 of a first length projecting below the cutting edge, as well as a plurality of second spikes of a second length substantially less than the first length, with the second spikes 28 arranged in cooperation with the single spike 27 to maintain non-slip alignment of the housing 11 in temporary mounting to a portion of sheetrock prior to a cutting procedure to thereby permit ease of positioning in alignment of the cutting tool.

Figure 9:
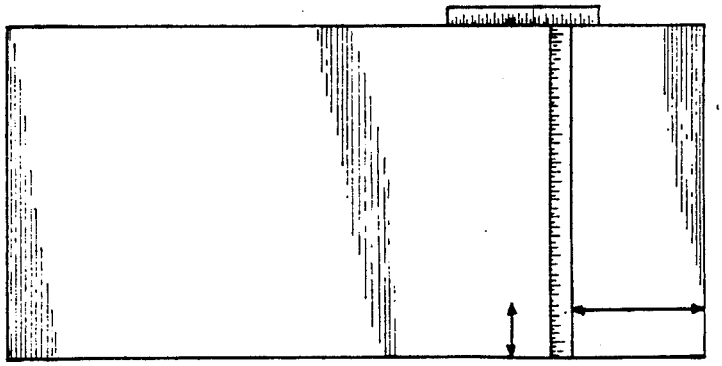
FIG. 9 is an orthographic view of a typical sheetrock member in cooperation with a T-square for proper positioning of indicator lines.
Figure 10:
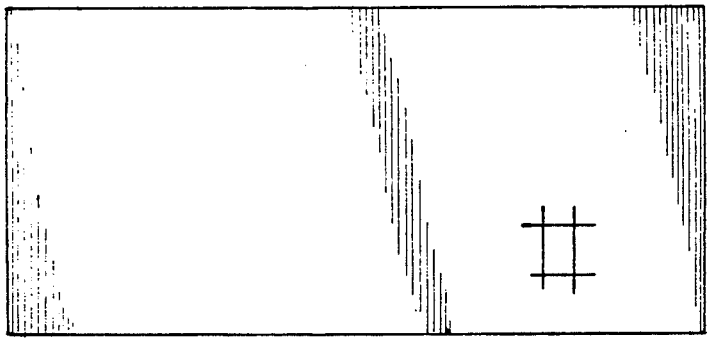
FIG. 10 is an orthographic view of the indicator lines effected by utilization of the T-square structure, as indicated in the FIG. 9.
Figure 11:
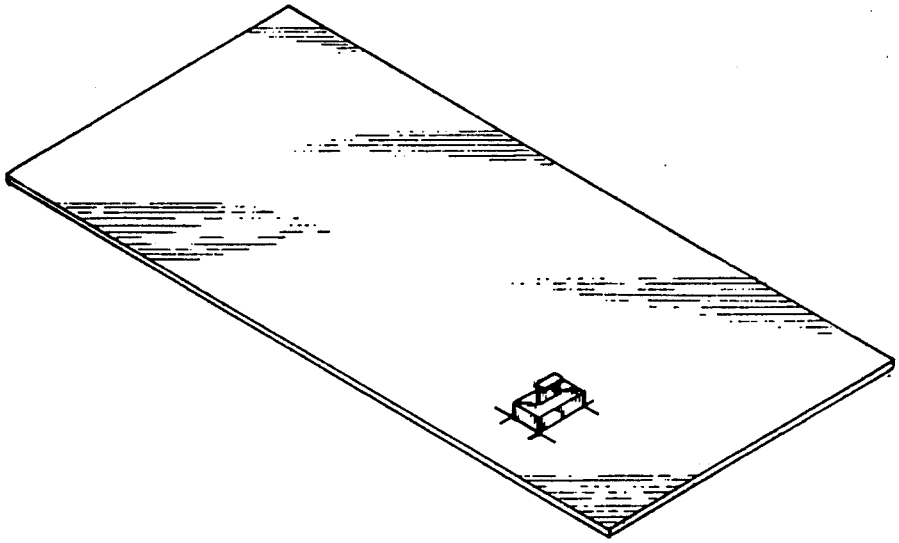
FIG. 11 is an isometric illustration of the invention mounted on the sheetrock component to effect a punching of an opening directed therethrough for the subsequent positioning of the opening relative to an electrical outlet structure.

In the utilization of the organization to effect the removal of a generally rectilinear component relative to a sheetrock wall surface, a T-square is incorporated typically of conventional construction, wherein such T-square is utilized both vertically and horizontally relative to the associated sheetrock to effect scribing of rectilinear marking to provide for precise positioning of the punch member, whereupon the punch member then is impacted to remove a sheetrock component to permit the positioning of the thusly formed aperture to be properly aligned relative to an electrical outlet in a construction environment. The sequence is indicated in the FIGS. 9–11 illustrating the positioning of the T-square structure in providing for the rectilinear marking or gauge lines of the FIG. 10 for the subsequent positioning of the punch member of the invention in the FIG. 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sheetrock cutting tool apparatus, comprising, a cutting tool housing, the cutting tool housing including a top wall and a continuous side wall orthogonally projecting downwardly relative to the top wall, wherein the continuous side wall includes a first side wall plate spaced from and parallel a second side wall plate in a coextensive parallel relationship, the continuous side wall includes a side wall lower edge, wherein the side wall lower edge includes a cutting edge, with the cutting edge arranged in a single plate, and the top wall includes a top wall forward edge spaced from and parallel a top wall rear edge, and a projecting flange fixedly and orthogonally mounted to the top wall spaced medially of the first side wall and the second side wall, with the impact plate orthogonally and medially bisecting the top wall forward edge and the top wall rear edge extending from the top wall forward edge to the top wall rear edge, and an impact plate fixedly and orthogonally mounted to an upper distal end of the projecting flange, and a plurality of projecting heads mounted between the projecting flange and the first side wall, and a plurality of second projecting heads mounted above the top wall between the projecting flange and the second side wall, and each projecting head includes a projecting rod slidably and orthogonally directed through the top wall, and a first ejector plate is mounted to a plurality of projecting rods below the first projecting heads, and a second ejector plate is mounted to a further plurality of projecting rods below the second projecting heads, wherein the first ejector plate and the second ejector plate is positioned within the housing below the top wall.

* * * * *